United States Patent [19]

Bizek

[11] Patent Number: 4,788,748

[45] Date of Patent: Dec. 6, 1988

[54] TORQUE HINGE HAVING ITS KNUCKLES INDIVIDUALLY CRIMPED AROUND THE HINGE PIN

[75] Inventor: Donald R. Bizek, Woodridge, Ill.

[73] Assignee: Stocker Hinge Manufacture Co., Brookfield, Ill.

[21] Appl. No.: 9,942

[22] Filed: Feb. 2, 1987

[51] Int. Cl.[4] ..... E05F 1/08

[52] U.S. Cl. ..... 16/308; 16/380; 16/386

[58] Field of Search ..... 16/228, 280, 308, 337, 16/339, 342, 380, 385, 386, DIG. 13, DIG. 36

[56] References Cited

U.S. PATENT DOCUMENTS

| | | | |
|---|---|---|---|
| 2,504,351 | 4/1950 | Ring . | |
| 2,872,697 | 2/1959 | Hizsa, Jr. . | |
| 3,035,864 | 5/1962 | Davidson | 296/97 |
| 3,233,277 | 2/1966 | Hirashiki . | |
| 3,349,430 | 10/1967 | Rosenvold et al. | 16/228 X |
| 3,546,735 | 12/1970 | Liautaud | 16/228 |
| 3,910,627 | 10/1975 | Meyer | 296/97 |
| 4,057,287 | 11/1977 | Lilja | 296/97 |
| 4,356,594 | 11/1982 | Grosemans | 16/256 |
| 4,490,884 | 1/1985 | Vickers | 16/338 |
| 4,630,332 | 12/1986 | Bisbing | 16/DIG. 13 X |

FOREIGN PATENT DOCUMENTS 7104049 3/1970 Netherlands .

*Primary Examiner*—Fred A. Silverberg
*Attorney, Agent, or Firm*—Keil & Weinkauf

[57] ABSTRACT

A permanently adjusted friction hinge assembly manufactured of metal and comprised of one or more hinge leaves with one or more circular through hole knuckles squeezed around a circular plastic pin or otherwise compressible material to provide frictional torque resistance between said pin and one or more hinge leaves. The inside diameter of all hinge leaf knuckles are permanently adjusted at moment of manufacture by the amount of compression applied to said knuckles around the pin.

10 Claims, 1 Drawing Sheet

TORQUE HINGE HAVING ITS KNUCKLES INDIVIDUALLY CRIMPED AROUND THE HINGE PIN

BACKGROUND OF THE INVENTION

The present invention is directed to a torque hinge assembly for use with a cover, lid, door, partitions, catalogue cases, or the like.

The invention relates in particular to a permanently adjusted friction hinge assembly having one or more leaves with one or more circular through hole knuckles squeezed around a circular plastic pin to provide frictional torque resistance between said pin and one or more of said hinge leaves.

The invention also relates particularly to a torque hinge assembly for a console located between the seats of an automobile whereby the cover or lid is movable relative to the base between a closed and an open position and in any other position between the closed and open position with the aid of resistance in the torque hinge which counteracts the force of gravity on the cover.

The invention further relates particularly to a torque hinge assembly for a hinged door which when opened will retain the open position against forces causing it to swing shut.

The invention even further relates to a torque hinge assembly applicable to more than one partition or catalogue case which may be opened individually and retain the open position subject to the same or different degree of torque relative to the other partitions or case.

Various forms of hinge assemblies have been designed and have been equipped with various means to adjust the extent to which the associated cover, lid, door or the like may be held between the closed and open position. Previous prior art hinge assemblies are designed and constructed so that upon tightening of adjustment screws, the plastic material embracing the reduced-diameter central portion of the hinge pin is tightened whereby preventing free rotational movement of the door or lid or cover relative to the hinge pin. However, these various adjustment structures make it difficult for a person unskilled with tools to adjust. Another prior art hinge assembly requires a balancing spring along with other components resulting in a complex mechanism. Examples of previously patented hinge assemblies are disclosed in U.S. Pat. Nos. 2,504,351; 2,872,697; 3,035,864; 3,233,277; 3,910,627; 4,057,287; 4,356,594; 4,490,884 and Netherlands No. 7,104,049.

SUMMARY OF THE INVENTION

The torque hinge assembly of the present invention comprises at least one hinge leaf which is movable about a plastic pin axis between a closed position and an open position, whereby at least one cylindrical knuckle applies torque friction to the plastic hinge pin axis to hold the leaf or leaves in any position between the closed and open position.

The principal object of the present invention is to provide a permanently adjusted friction hinge in which the rotational movement of hinge leaves relative to each other is controlled solely at the moment of manufacture and eliminates the need for any further adjustment.

Another object is to provide a permanently adjusted friction hinge assembly of any length, consisting of any number of hinge leaves and knuckles in order to achieve an equalized distribution of torque over the entire length of said assembly.

Another object is to provide a permanently adjusted friction hinge in which all leaves rotate about the pin with either the same or varying degrees of torque relative to each other.

A further object of the present invention is to provide a simple torque hinge assembly which can be utilized on substantially any cover, lid, door, partition, catalogue case or the like which can be hingedly supported by means of a simple hinge assembly having an axially hinge pin.

A further object is to provide an improved torque hinge assembly which prevents covers, lids and the like from dropping to the closed position from the open position and resists doors, partitions and catalogue sections from closing shut from the open position.

A still further object is to provide a plastic hinge pin which is hard, compressible, durable, resistant to heat and solvent, having good bearing properties and produces smooth hinge action.

A further object is to provide a durable hinge assembly with the proper torque that will maintain the torque over the full useful life of the hinge.

These and other objects are accomplished by providing a hinge of a metal material so designed and constructed, that upon crimping of a hinge knuckle or knuckles around a compressible pin material, the pin diameter is reduced. The resulting expansive memory of the pin material provides frictional torque between said pin and the inside diameter of the hinge knuckles. By tightening the individual knuckles, the plastic hinge pin is firmly crimped in place and resists free movement of the cover, lid, door, partition, catalogue leaves, or the like about the axis hinge pin.

BRIEF DESCRIPTION OF THE DRAWINGS

The invention is described in more detail with reference to the drawing, in which.

DETAILED DESCRIPTION OF THE PREFERRED EMBODIMENTS

Figure 1:
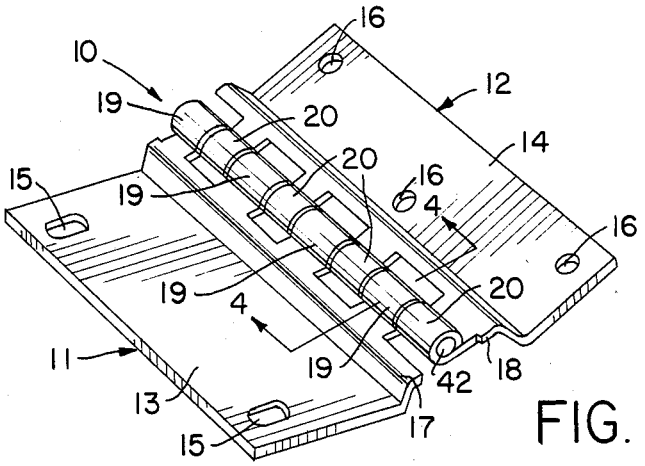
FIG. 1 is a front or top perspective view of the torque hinge assembly in general.

Referring now more specifically to the drawings, FIG. 1, depicts one embodiment of the improved torque hinge assembly of the present invention. The position of the torque hinge in FIG. 1, is depicted in the horizontal position however the present torque hinges are also used on covers, lids, doors, partitions, catalogue cases etc., that swing on torque hinges placed in the vertical position. In both the horizontal and vertical uses, the present torque hinge will resist closing of the cover, lid or door from the open position.

Figure 2:
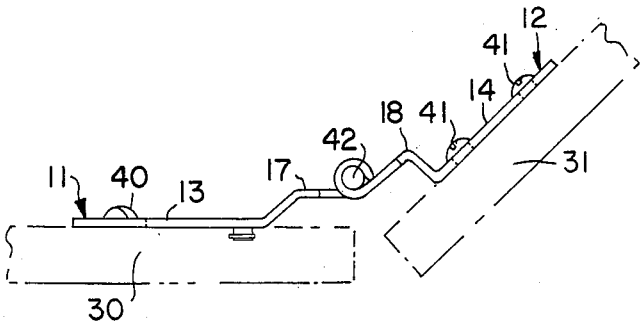
FIG. 2 is an end view of the torque hinge assembly showing how the hinge would be mounted to a base and cover.
Figure 3:
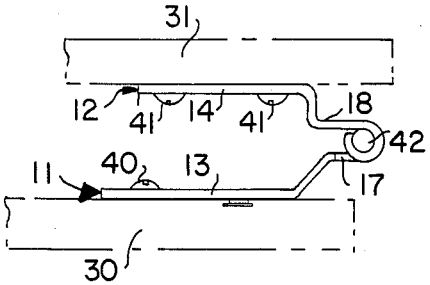
FIG. 3 is an end view of the torque hinge assembly shown with the entire assembly in the closed position.

The present torque hinge assembly can have one or more hinge leaves. FIGS. 1-3, depict an embodiment of the present invention wherein the torque hinge assembly 10 comprises two opposing hinge leaves 11 and 12.

Either one of these leaves can be attached to the base or frame while the other can be attached to the cover, lid, door, etc. In FIG. 2, it is depicted that hinge leaf 11 is secured to the base of frame 30 while hinge leaf 12 is secured to the cover or lid 31. It is again pointed out that hinge leaf 11 could be secured to the cover or lid while hinge leaf 12 could be secured to the base or frame and have the same effect.

Figure 4:
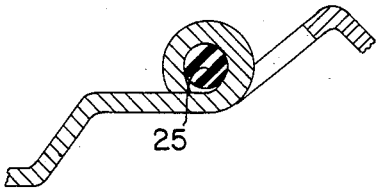
FIG. 4 is an enlarged sectional view taken along line 4—4 of FIG. 1 showing how the cylindrical portions of the assembly apply the torque friction to the plastic hinge pin.

It is shown in FIGS. 1-3, that hinge leaf 11 is comprised of a flat section 13 which contains two holes 15 for receiving screws 40 and a ledge section 17. Hinge leaf 11 further contains four spaced apart knuckles 19 each of which forms a circular center hole 42 in order to receive the correspondingly circular shaped plastic hinge pin 25 as shown in FIG. 4.

Hinge leaf 12 has a similar structure as hinge leaf 11. Hinge leaf 12 is also comprised of a flat section 14 which contains three holes 16 for receiving screws 41 and a ledge section 18. Hinge leaf 12 similarly contains a multiple of spaced apart knuckles 20 each of which forms a circular hole 42 in order to receive hinge pin 25.

The torque hinge is constructed by axially aligning the interdigitated hinge knuckles of hinge leaves 11 and 12 and telescoping the plastic hinge pin 25 downwardly through the hinge circular holes 42. The leaves are then controlled in their relative positions by tightening the individual knuckles 19 and/or 20 so as to firmly crimp around the plastic hinge pin 25.

An inventive concept of the present torque hinge assembly is the production of a permanently adjusted friction hinge assembly in which the rotational movement of the hinge leaves relative to each other is set at the time of manufacture. This eliminates the need for any further adjustment when in use as opposed to prior art assemblies.

The permanently adjusted friction torque assembly can be of any length having any number of hinge leaves and knuckles to achieve either equalized distribution of torque or varying degrees of torque over the entire length of the assembly. The present invention is applicable to any hinge of a metal material so designed and constructed that upon crimping of hinge knuckles around a compressible material having the required characteristics, the pin diameter is reduced. The resulting expansive memory of the required pin material provides frictional torque between said pin and the inside diameter of the hinge knuckles resulting in the unique torque assembly of the present invention.

An equalized distribution of torque friction over the entire length of the assembly is obtained by applying the same amount of torque friction to the pin from each knuckle. Variations in degrees of torque friction are produced by applying more, less or no crimping pressure to the pin from the knuckles.

Variations in degrees of torque friction are useful when two or more consecutive leaves are attached to different covers, lids, doors, partitions, catalogue case segments, or the like. Such a situation would be required for catalogue cases which would require different degrees of torque friction for the sectional components of the catalogue case.

The permanently adjusted friction hinge assembly can be of any length, can have any number of leaves, can have any number of knuckles and can have any number of plastic pins. The length of the assembly will depend upon its application such as on the size of the cover etc. or the number of leaves and knuckles involved. There might be only one leaf required such as when the pin is set in a support other than a leaf. Two or more consecutive leaves might be required for example when two or more covers, lids etc. are being supported. The use of one or more knuckles will be dependent on the requirements such as size, weight, bulk, etc. of the covers, lids, etc. Usually only one plastic pin is required although more than one pin can be used for example when conditions dictate the use of different diameter pins.

The unique plastic hinge pin of the present invention is prepared from plastic or other compressible material which results in a hard hinge pin which can be compressed slightly and retains a resulting expansive memory giving it a pressure feature providing the frictional hinge torque between the pin and the inside diameter of the hinge knuckles. In some cases it is desired that the plastic be heat resistant up to about 200° F. for certain painting operations and withstand a degreasing type dip such as in trichloroethylene with a blowing off or immediate drying operation. A specific plastic is Nylaton® NSB which has excellent torque properties and maintains the properties over the useful life of the hinge. It has good bearing properties producing smooth hinge action.

The foregoing is considered as illustrative only of the principles of the invention. Accordingly suitable modifications within the skill of the art are deemed to be within the scope of the invention.

What is claimed is:

1. A permanently adjusted torque hinge assembly comprising a hinge having at least one hinge leaf with at least one circular through hole knuckle wherein at least one knuckle is crimped around a circular pin of hard, slightly compressible material which retains a resulting expansive memory and provides frictional torque resistance between said pin and said hinge leaf, wherein said pin has a deformable surface, said deformable surface being made of plastic, said hinge having opposing hinge leaves, said hinge leaves having spaced interfitting knuckles whereby said leaves are joined through the spaced interfitting knuckles by said pin being inserted through said knuckles, wherein all of said knuckles are individually and separately crimped around said pin to thereby deform said deformable surface to obtain a distribution of torque over the entire length of said assembly.

2. A torque hinge assembly according to claim 1 wherein said hinge is made of metal.

3. A torque hinge assembly according to claim 1 wherein the entire pin is made of plastic.

4. A plastic pin according to claim 3 having heat resistance of up to 200° F., resistance to degreasing in trichloroethylene and good bearing properties.

5. A plastic pin according to claim 3 prepared from type 6/6 nylon.

6. A torque hinge assembly according to claim 1 wherein the knuckles are crimped around said pin to obtain varying degrees of torque relative to each other.

7. A torque hinge assembly according to claim 1 used to connect a cover or lid to a base.

8. A torque hinge assembly according to claim 7 wherein the base is a console.

9. A torque hinge assembly according to claim 1 used to connect a door to a support.

10. A torque hinge assembly according to claim 1 used in a catalogue case.

* * * * *